US007617954B2

(12) United States Patent
Skillin

(10) Patent No.: US 7,617,954 B2
(45) Date of Patent: Nov. 17, 2009

(54) DISPENSING CLOSURE WITH LATCH BACK

(75) Inventor: Clifford W. Skillin, Blackstone, MA (US)

(73) Assignee: Polytop Corporation, A Rhode Island Corporation, Slatersville, RI (US)

( * ) Notice: Subject to any disclaimer, the term of this patent is extended or adjusted under 35 U.S.C. 154(b) by 200 days.

(21) Appl. No.: 11/876,067

(22) Filed: Oct. 22, 2007

(65) Prior Publication Data

US 2008/0035681 A1 Feb. 14, 2008

Related U.S. Application Data

(63) Continuation-in-part of application No. 10/960,179, filed on Oct. 7, 2004, now Pat. No. 7,322,493.

(60) Provisional application No. 60/895,084, filed on Mar. 15, 2007.

(51) Int. Cl.
*B65D 47/00* (2006.01)

(52) U.S. Cl. ..... 222/556; 220/831; 215/245

(58) Field of Classification Search ..... 222/556, 222/557, 517, 518, 153.14, 498; 220/831, 220/832, 817, 819, 837–839; 215/235–238, 215/245

See application file for complete search history.

(56) References Cited

U.S. PATENT DOCUMENTS

| | | | |
|---|---|---|---|
| 4,010,875 | A | 3/1977 | Babiol |
| 4,158,902 | A | 6/1979 | Chernack et al. |
| 4,573,600 | A | 3/1986 | Dubach |
| 4,635,823 | A | 1/1987 | Stull |

(Continued)

FOREIGN PATENT DOCUMENTS

| | | | |
|---|---|---|---|
| DE | 7631199 | U | 1/1977 |

(Continued)

*Primary Examiner*—Lien T Ngo
(74) *Attorney, Agent, or Firm*—Barlow, Josephs & Holmes, Ltd.

(57) ABSTRACT

A dispensing closure for a container is disclosed. The dispensing closure includes a closure body including an upper wall having a dispensing orifice. The closure body further includes an upper peripheral skirt depending from the upper wall, a closure deck depending from the upper peripheral skirt, and a lower peripheral skirt depending from the closure deck. The lower peripheral skirt has a diameter larger than the upper peripheral skirt. The lower peripheral skirt is configured to be mounted on a container. A cap having an upper wall and a wall flange depends from the upper wall. A hinge body is also included. A first living hinge joins a first end of the hinge body to the lower peripheral skirt and is hingeably movable from an open position to a closed position in facing mating relation with the upper peripheral skirt. The hinge body and the upper peripheral skirt include interfitting mating formations to secure the hinge body in facing mating relation with the upper peripheral skirt. A second living hinge joins a second end of the hinge body to the sealing cap. The sealing cap is hingeably movable from an open position to a closed position overlying the upper wall of the closure body. A latch bump is also included and may be located on either the closure deck adjacent to the hinge or on the hinge adjacent to the closure deck. A latch bead is formed on the upper wall of the cap.

17 Claims, 18 Drawing Sheets

U.S. PATENT DOCUMENTS

| | | | | | |
|---|---|---|---|---|---|
| 4,778,071 | A | | 10/1988 | Fillmore | |
| 4,917,253 | A | | 4/1990 | Dutt | |
| 5,007,555 | A | * | 4/1991 | Beck | 220/254.3 |
| 5,067,624 | A | * | 11/1991 | Thanisch | 215/235 |
| 5,088,612 | A | | 2/1992 | Storar et al. | |
| 5,271,536 | A | | 12/1993 | Wilson | |
| 5,328,058 | A | * | 7/1994 | Leoncavallo et al. | 222/153.14 |
| 5,437,383 | A | | 8/1995 | Stull | |
| 5,735,418 | A | * | 4/1998 | Erb et al. | 215/237 |
| 5,938,087 | A | | 8/1999 | Randall | |
| 6,102,257 | A | * | 8/2000 | Goyet | 222/498 |
| 6,116,477 | A | | 9/2000 | Kreiseder et al. | |
| 6,305,563 | B1 | | 10/2001 | Elliott | |
| 6,478,184 | B2 | | 11/2002 | Berge et al. | |
| 6,481,588 | B1 | * | 11/2002 | Wagner | 215/235 |
| 6,766,926 | B1 | | 7/2004 | Elchert | |
| 6,837,402 | B2 | | 1/2005 | Cardia | |
| 2005/0087550 | A1 | | 4/2005 | Skillin | |
| 2006/0011667 | A1 | | 1/2006 | Skillin et al. | |
| 2007/0138124 | A1 | | 6/2007 | Skillin | |

FOREIGN PATENT DOCUMENTS

| | | | |
|---|---|---|---|
| EP | 1386849 | A1 | 4/2004 |
| GB | 207638 | | 12/1923 |

* cited by examiner

DISPENSING CLOSURE WITH LATCH BACK

CROSS-REFERENCE TO RELATED APPLICATION

The present application claims priority to earlier filed U.S. Provisional Patent Application Ser. No. 60/895,084, filed Mar. 15, 2007, and is a continuation-in-part of U.S. patent application Ser. No. 10/960,179, filed Oct. 7, 2004, the entire contents of which are incorporated herein by reference.

BACKGROUND OF THE INVENTION

1. Field of the Invention

The present application is related to dispensing closures for containers and more specifically to a dispensing closure that includes a latch back structure to restrain the lid when dispensing the contents of the container.

2. Background of the Related Art

Dispensing containers are used in a variety of industries for the dispensing of various liquid products. For example, in the beauty industry, products such as shampoo, conditioner, creams and lotions are all packaged in flexible containers having a dispensing closure mounted thereon. Such dispensing containers are also used in the food industry for various condiments, such as ketchup, mayonnaise, and syrups.

One important aspect to the mounting of a dispensing closure in the food industry is retaining the lid in an open position so that the lid does not interfere with dispensing of the product. Often times, the lid naturally tends to return to the closed position after opening due to the memory aspect of the plastic. When this occurs, the lid Interferes with dispensing of the product, making for a messy dispensing experience, and fouls the lid surfaces, making it difficult to close the lid.

Accordingly, there is believed to be a need in the industry for a dispensing closure having a latch back feature, which will retain the lid in an open position during dispensing.

SUMMARY OF THE INVENTION

The closure of the present invention obviates such problems in an efficient, low-cost fashion through use of a molded single-piece plastic construction with integrally molded living hinges and integrally molded features on the closure body and lid which interlock to maintain the lid in an open position.

Generally, the dispensing closure comprises a closure body, a cap or lid, and a hinge body having a first living hinge connecting the hinge body to the closure body, and a second living hinge connecting the hinge body to the cap. The closure body includes an upper wall having a dispensing orifice, an upper peripheral skirt depending from the upper wall, a closure deck depending from the upper peripheral skirt, and a lower peripheral skirt depending from the closure deck. The lower peripheral skirt has a diameter larger than the upper peripheral skirt and is configured to be mounted on a container, either by a thread or a snap bead. The cap has an upper wall and a wall flange depending from the upper wall. The hinge body is hingeably movable about the first living hinge from an open position to a closed position in facing mating relation with the upper peripheral skirt. To retain the hinge body in position, the hinge body and the upper peripheral skirt including interfitting mating formations to secure the hinge body in facing mating relation with the upper peripheral skirt. A second living hinge joins the hinge body to the sealing cap. The sealing cap is hingeably movable from an open position to a closed position overlying the upper wall of the closure body.

More specifically with regard to the latch back feature, the closure deck is provided with a latch bump adjacent to the hinge body. The latch bump is formed on the surface of the closure deck and protrudes upwardly through a clearance window within the hinge body. A latch bead is formed on the upper wall of the cap. When the cap is moved 180 degrees from the closed position to the open position, the lid latch bead engages with the latch bump and retain the cap or lid in a fully open position.

Positioning the latch bump on the closure deck provides significant advantages in molding and allows for a substantial bump structure that can securely engage the latch bead.

Other advantages and features of the present advantage will become apparent in the drawings and detailed description.

DETAILED DESCRIPTION OF THE PREFERRED EMBODIMENTS

Figure 1:
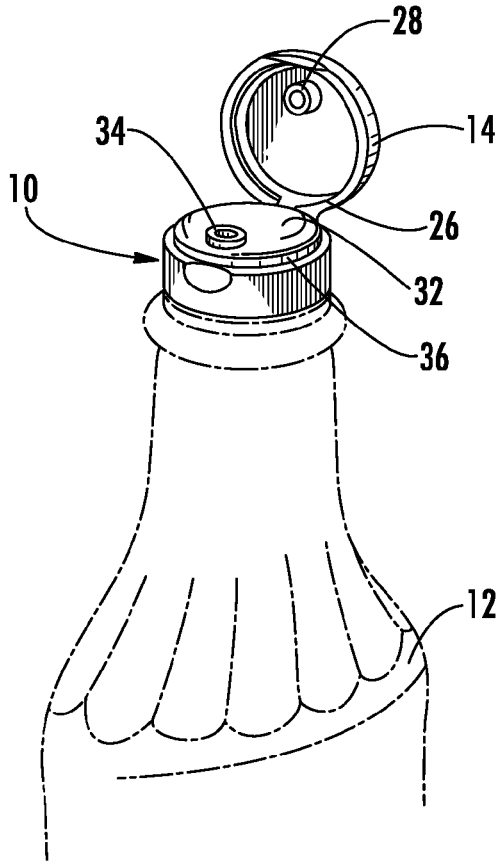
FIG. 1 is a perspective view of a first dispensing closure, constructed in accordance with the principles of the instant invention, applied to a container.

Referring now to the drawings, FIG. 1 depicts a first embodiment of a dispensing closure constructed in accordance with the principles of the invention. The dispensing closure is generally identified at 10, and is shown secured to the upper end of the neck of container 12. Container 12 may assume the form of a plastic bottle, which may be tilted, and squeezed, to discharge its contents through closure 10.

Figure 2:
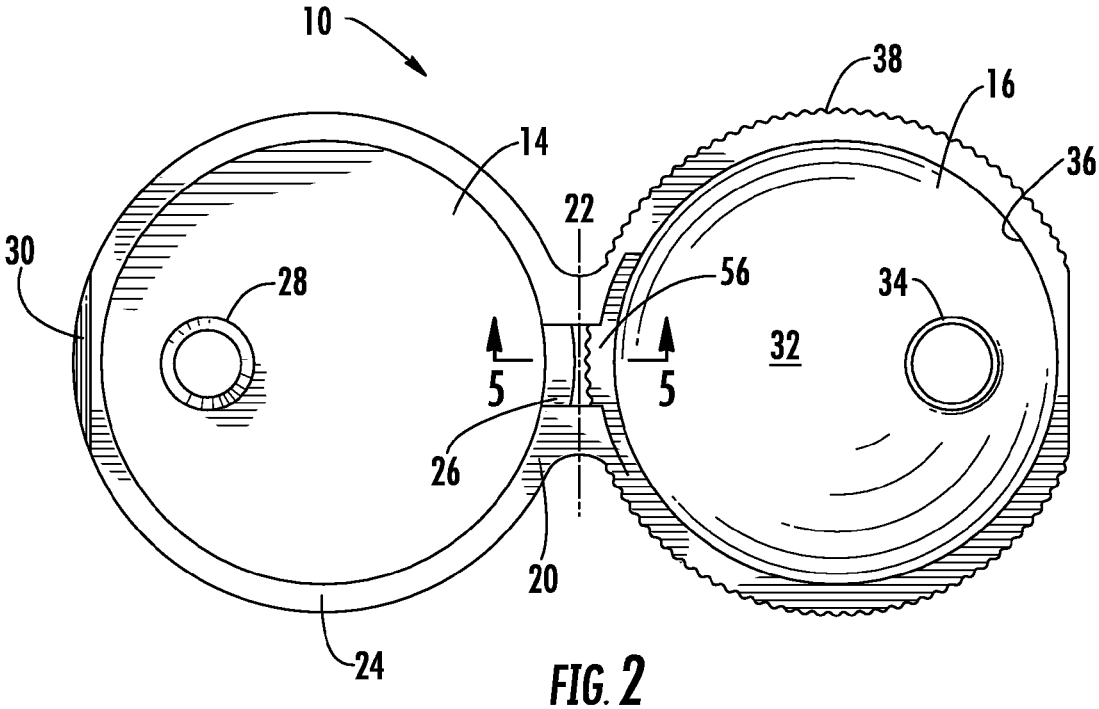
FIG. 2 is a top plan view of the dispensing closure, on an enlarged scale, such view showing the dispensing closure in its as-molded condition.

FIG. 2 shows dispensing closure 10 in its as-molded condition, prior to its securement to container 12. Closure 10 comprises sealing cap 14, a closure body 16, and a pair of hinges 18, that join the sealing cap to the closure body. Sealing cap 14 is pivoted along the center line 22 of the hinges relative to closure body 16.

Figure 3:
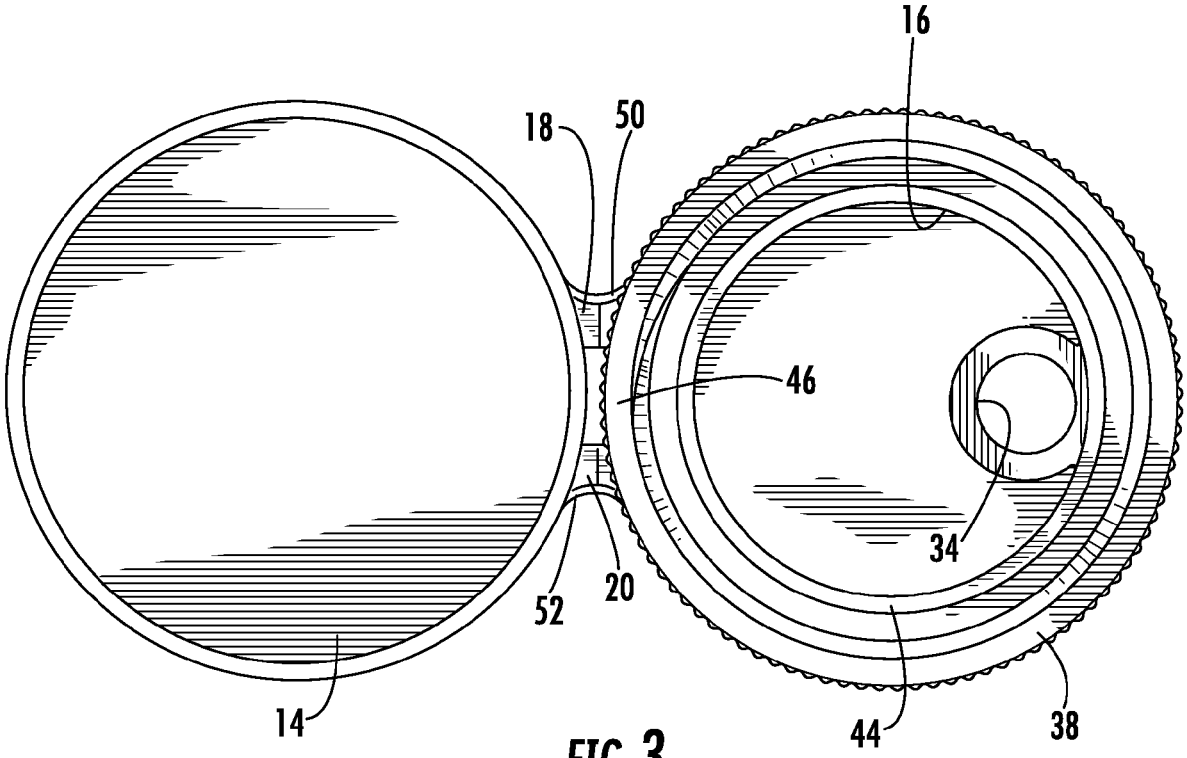
FIG. 3 is a bottom plan view of the dispensing closure of FIG. 2.

Sealing cap 14, as shown in FIGS. 2 and 3, includes an annular flange 24, a camming lug 26 located on flange 24 in proximity to closure body 16, and a depending peg 28. Camming lug 26 is curved, when viewed from above, and follows the contour of flange 24. Flange 24, remote from camming lug 26, is reduced in thickness to form gripping surface 30.

Closure body 16 includes a smooth upper wall 32 interrupted by dispensing orifice 34; the dispensing orifice communicates with the interior of the closure body. An annular sealing surface 36 is located below upper wall 32, and encircles closure body 16, and skirt 38 below the upper wall 32. Horizontal ledge 40 is formed between annular sealing surface 36 and skirt 38. An indentation 42 is formed in the exterior surface of skirt 38 at a location remote from hinges 18, 20, and in alignment with camming lug 26.

Locator ring 44 depends below upper wall 32 into the interior of closure body 16, and internal threads 46 are arranged in helical fashion around the interior of skirt 38. Ring 44 engages the end of the neck of container 12 to which dispensing closure 10 is applied, while threads 46 cooperate with complementary threads, or lugs, on the neck of the container 12 to secure dispensing closure 10 in fixed position.

FIGS. 2 and 3 show a dispensing closure, which is a unitary molding, in its as-molded condition, as it exits the mold. However, prior to use, in order to properly orient the molecular structure of the molded plastic in the area of living hinges 18, 20, sealing cap 14 is pivoted 180 degrees to its closed position. The sealing cap 14 as in FIGS. 6 and 7 indicates the position into which sealing cap 14 is pivoted to achieve the desired molecular orientation. Hinges 18, 20 are thin, resilient plastic members that are deformed repeatedly over the useful life of the dispensing closure, so that sturdy, durable hinges are necessary for successful operation.

Figure 4:
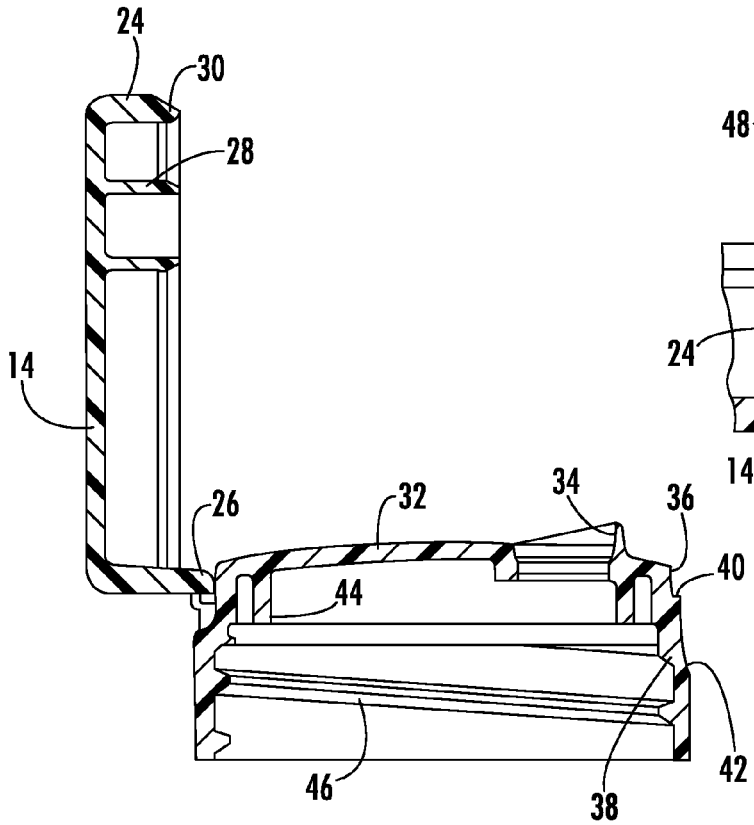
FIG. 4 is a vertical cross-sectional view of the dispensing closure with the sealing cap pivoted to its vertically oriented, opened position.
Figure 5:
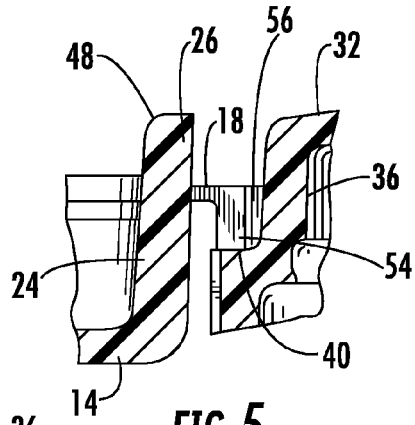
FIG. 5 is a fragmentary vertical cross-sectional view of the camming lug on the sealing cap that cooperates with a rigid wall on the closure body, such view being taken on an enlarged scale.

Camming lug 26 as shown in FIG. 5, extends beyond flange 24. Consequently, when sealing cap 14 is pivoted to the upright position (shown in FIG. 4), camming lug 26 engages, and slides along annular sealing surface 36 on closure body 16. The interference between camming lug 26 and annular sealing surface 36 stresses hinges 18, 20, and aligns the molecular structure of the plastic within the hinges. Edge 48 of camming lug 26 is rounded so that the camming lug does not gouge annular sealing surface 36, an important consideration since sealing cap 14 is pivoted to its closed position shortly after removal from the mold. Rounded edge 48 also enhances the snap-action of sealing cap 14.

Camming lug 26 is strategically located between spaced hinges 18, 20, for effectively stressing same within their elastic limits. The hinges may be strengthened, if warranted, by the addition of reinforcing ribs 50, 52. The ribs are visible in FIG. 3, and conform to the contour of the exterior edges of the hinges. The gap between sealing cap 14 and closure body 16, that is spanned by hinges 18, 20, is also visible.

Hinges 18 and 20 are each integrally formed with a holder. Holder 54 for hinge 18 is shown in FIG. 5, and a similar holder (not shown) is formed with hinge 20. In order to impart a limited degree of resiliency to holder 19, an arcuate recess 56 is removed from skirt 38 in the vicinity of the hinges and camming lug 26. The size and shape of segment 56 is shown in FIG. 2.

Recess 56 imparts resiliency to holder 54 for hinge 18, and does the same for the holder for hinge 20. The limited resiliency of the holders for hinges 18, 20 permits some relaxation of the close tolerances associated with dispensing closures, without sacrificing desirable operational characteristics.

Figure 6:
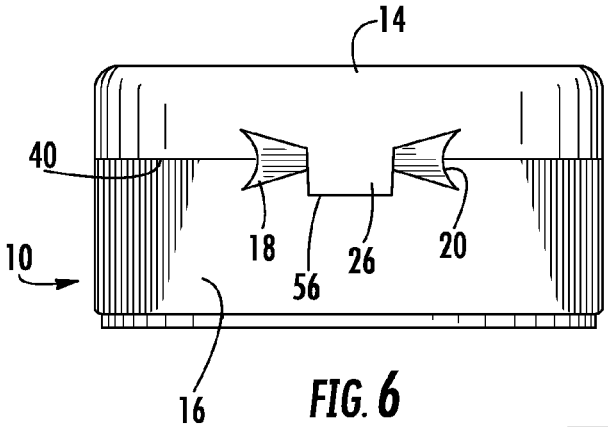
FIG. 6 is a rear elevational view of the dispensing closure showing the hinges that join the sealing cap to the closure body.

As shown in FIG. 6, recess 56 receives camming lug 26 when sealing cap 14 is swung into sealing engagement with closure body 16. Flange 24 of sealing cap 14 contacts ledge 40 to form a snug seal about the circumference of ledge 40. The inner surface of flange 24 contacts annular sealing surface 36 to further enhance the efficiency of the sealing action, which keeps water and/or other fluids from reaching the interior of the closed dispenser closure. Additionally, dispensing closure 10, when closed, assumes a compact, or low, profile.

Figure 7:
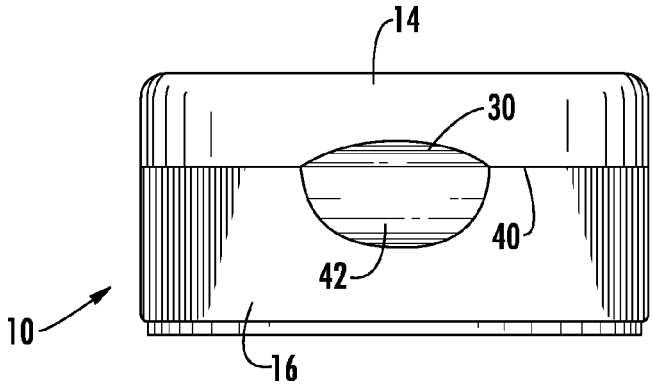
FIG. 7 is a front elevational view of the dispensing closure showing the gripping surfaces that allow the user to open the dispensing closure.

FIG. 7 shows gripping surface 30 on sealing cap 14 in relationship to indentation 42 on skirt 38 of closure body 16. Surface 30 and indentation 42 cooperate to allow the user of the cap to insert his finger beneath sealing cap 14 and manually lift same. After the sealing cap is pivoted partially toward its vertical, or opened position, camming lug 26, in concert with hinges 18, 20 imparts a snap-action to the sealing cap. Sealing cap 14 is retained in its vertical position by camming lug 26 pressing against annular sealing surface 36 on the closure body, in opposition to the forces imparted by hinges 18 and 20, as shown in FIG. 4.

Closure 10, as shown in FIGS. 1-7 and as described in the foregoing specification, realizes several advantages over known dispensing closures. To illustrate, the significant sealing area defined between flange 24 and ledge 40, as well as the back-up seal between the surface of annular sealing surface 36 and flange 24, allows the closure to be used on food products, such as ketchup, syrups, and the like. After filling, containers, for such products, such as flexible plastic bottles, are subjected to warm water baths to wash away excess product, dust, and the like. Such warm water baths have occasionally left droplets of water behind—an unsightly proposition that offends the ultimate user and may even pose a minor health hazard. Closure 10, as presently configured, obviates such problem in an efficient, lowcost fashion.

Furthermore, the use of pair of spaced hinges 18, 20, has materially increased the resistance of closure 10 to twisting forces. Such forces come into play as automated capping machinery applies torque to the closure to screw same onto the neck of a container or if consumers twist the closure to remove it from the neck of the container.

Hinges 18 and 20 are folded when sealing cap 14 is engaged, in sealing relationship, with closure body 16. As shown in FIG. 6, the folded hinges project outwardly a small distance from the closure body, and do not interfere with the sealing engagement of flange 24 and ledge 40, and/or with the interior surface of flange 24 and annular sealing surface 36. Also, closure 10 is aesthetically pleasing, with a slightly curved upper wall 32 on closure body 16, such wall being unbroken except for dispensing orifice 34. The manner in which camming lug 26 fits into recess 56 when sealing cap 14 is closed, is also pleasing to the eye, and precludes accumulation of excess food product, and/or dire, after discharge from container 12.

Figure 8:
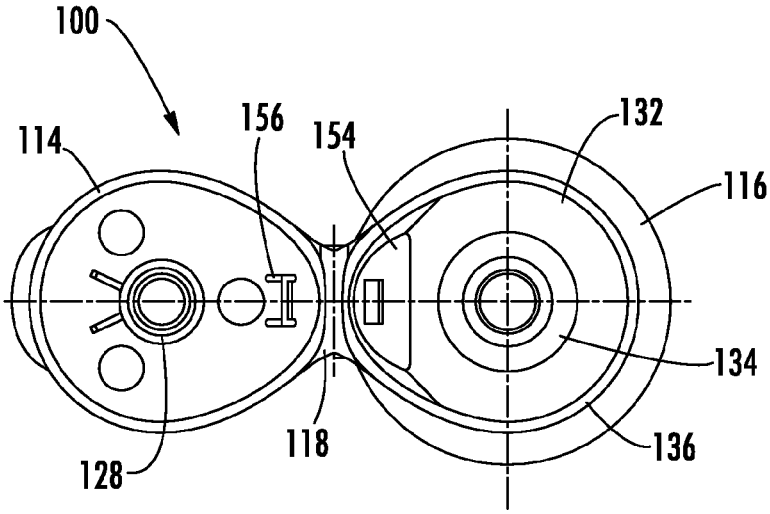
FIG. 8 is a top plan view of an alternative embodiment of the invention wherein the dispensing spout, i.e. orifice has been moved to the central axis of the closure.

Referring now to FIG. 8, an alternative closure generally indicated at 100 comprises a sealing cap 114 and a closure body 116 connected by hinge 118. The closure 100 generally has a taller configuration and the dispensing orifice 134 is centered on the closure body 116. the dispensing orifice 134 is composed a narrower upper channel 134*a* and a wider lower channel 134*b* to employ fluid dynamic principles to minimize spillage of the contents after the consumer dispenses the desired amount of product.

Sealing cap 114 is pivoted about the hinge between an open and closed configuration. Closure body 116 is provided with deck 132 and dispensing orifice 134 centrally located and extending upwardly from deck 132. Extending about the full circumference of the deck is sealing surface 136. Located inwardly of this sealing surface is rib 152 and recess 154.

Figure 9:
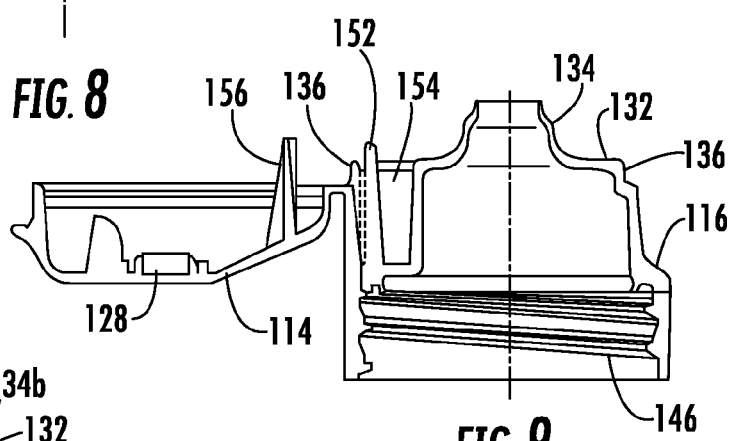
FIG. 9 is a cross-sectional view with the cap in the open position.

The structure of the sealing cap can also be seen in the cross-sectional view of FIG. 9. As can be seen, the sealing cap 114 is provided with a plug 128 that cooperates with dispensing orifice 134. Extending from the sealing cap is a peripheral skirt that cooperates with the sealing surface 136. Extension 156 extends from the underside of the sealing cap 114 and whose function will be described later. As can be seen, the closure has threads 146 for attaching the closure to the neck of a bottle.

Figure 10:
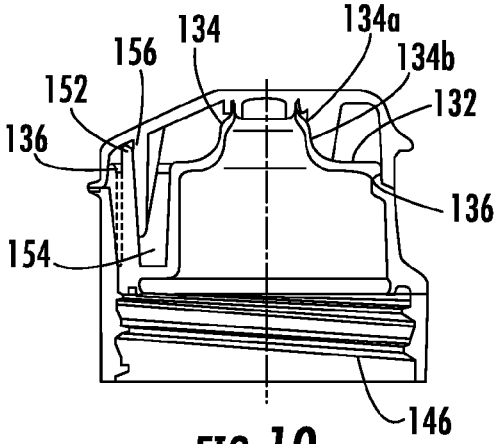
FIG. 10 is a cross-sectional view with the cap in the closed position.

FIG. 10 shows an enclosed configuration of the closure. Clearly seen is the plug 128 in engagement with the dispensing orifice 134. Also, the seal between the skirt of the sealing cap and the annular sealing surface 136 is completely seen, including the seal immediately adjacent the hinge. The seal between the skirt and annular sealing surface 136 extends about the entire periphery of the deck. As can be seen in this figure as well, is the placement of the extension 156 into the recess 154. As can be seen, while closing the sealing cap, rib 152 and extension 156 come into direct contact, providing a camming action when the sealing cap is opened and closed.

Figure 11:
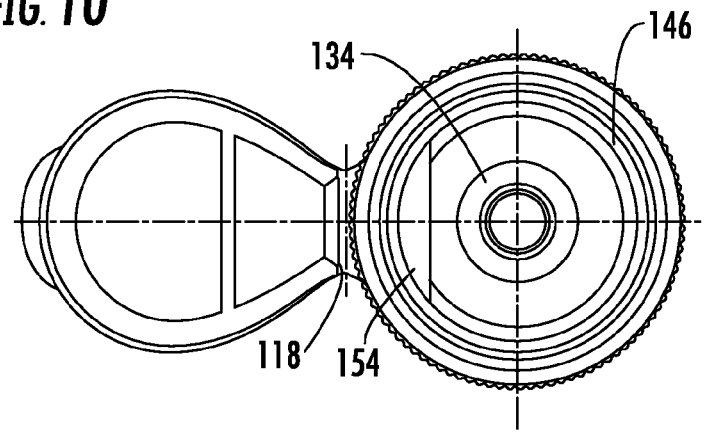
FIG. 11 is a bottom view of the closure with the cap in the open position.
Figure 12:
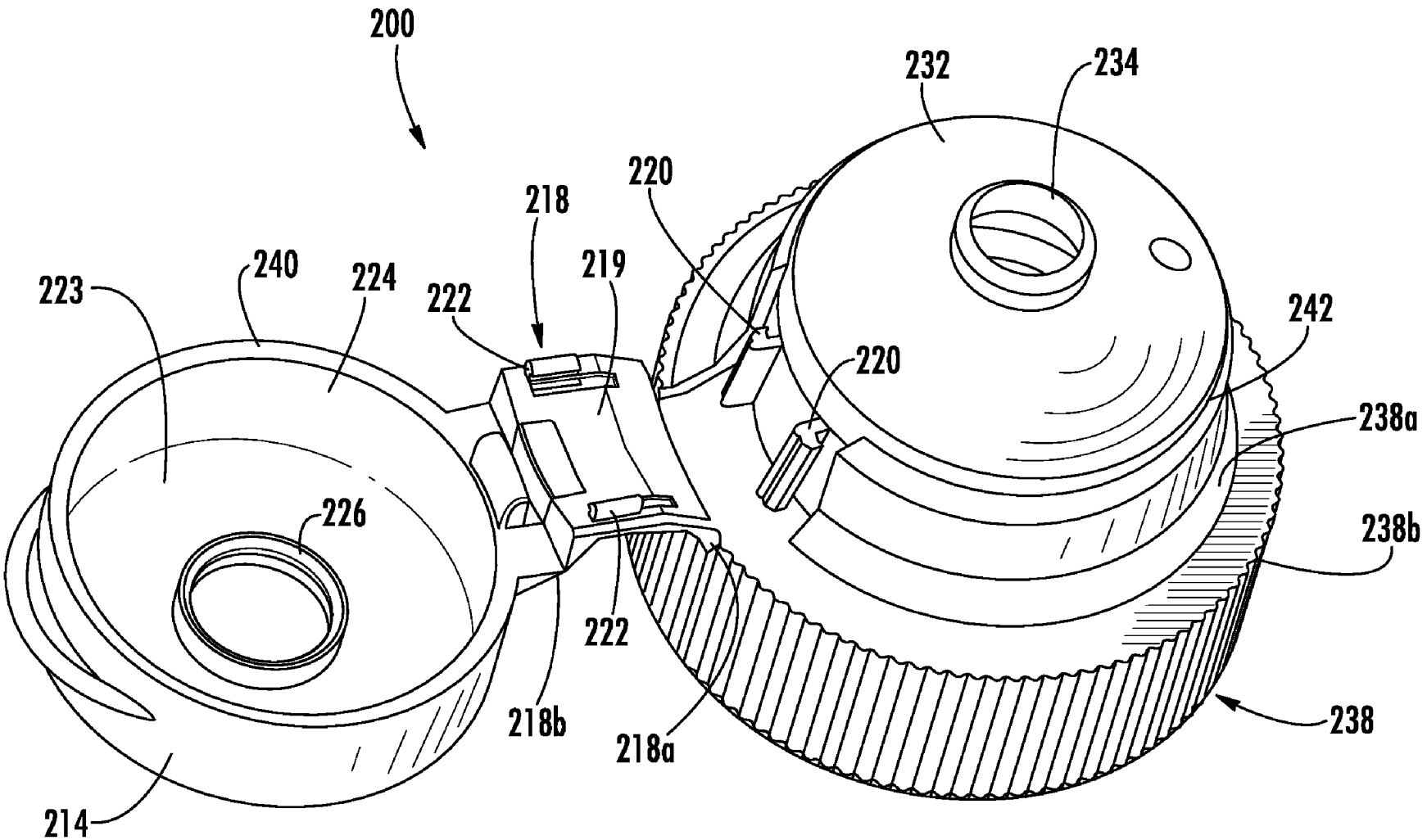
FIG. 12 is a perspective of a third and most preferred embodiment of the invention showing the cap in its as-molded condition.
Figure 13:
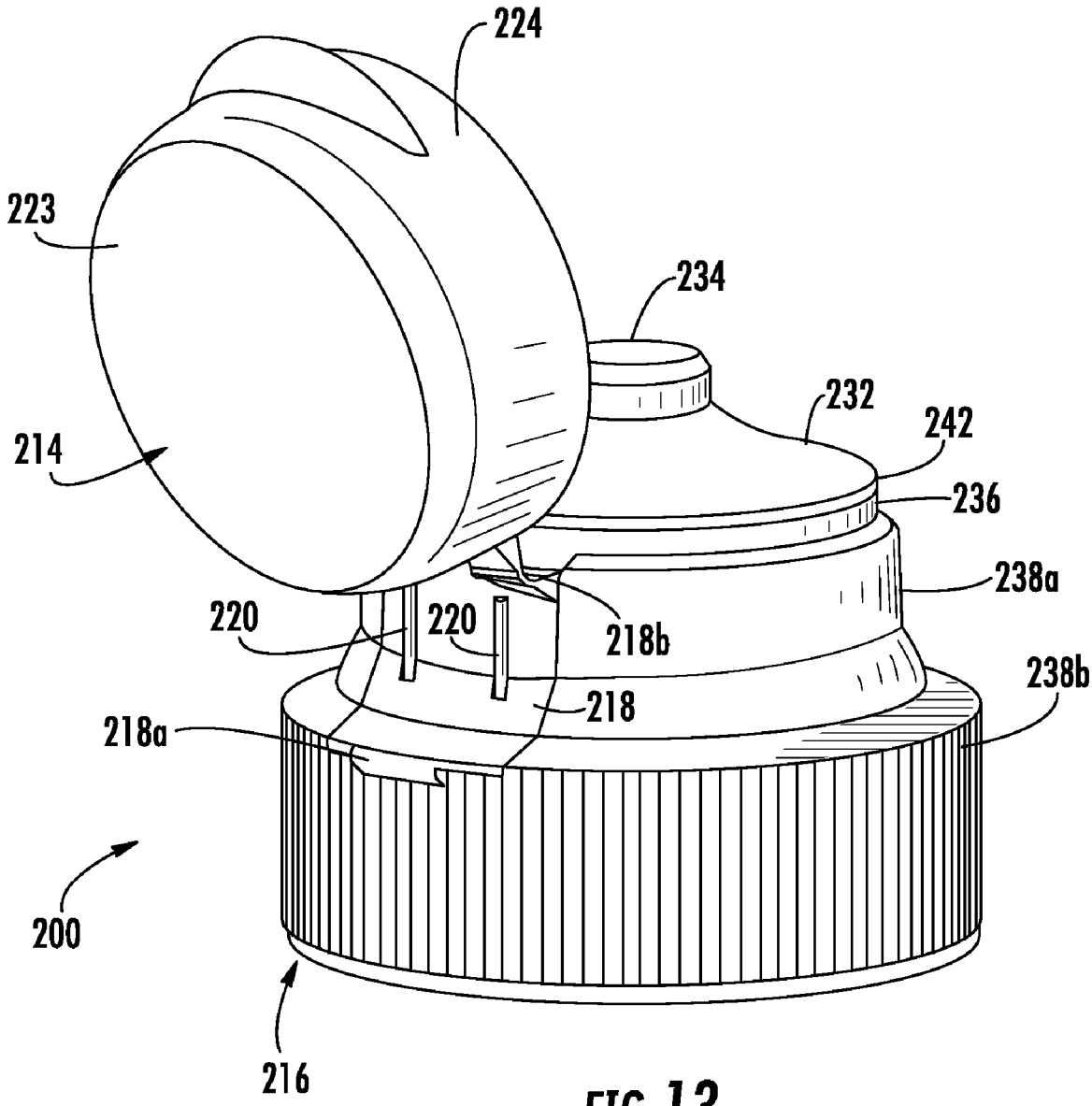
FIG. 13 is another perspective view thereof showing the cap in an intermediate position with the hinge arm locked onto the body of the cap.
Figure 14:
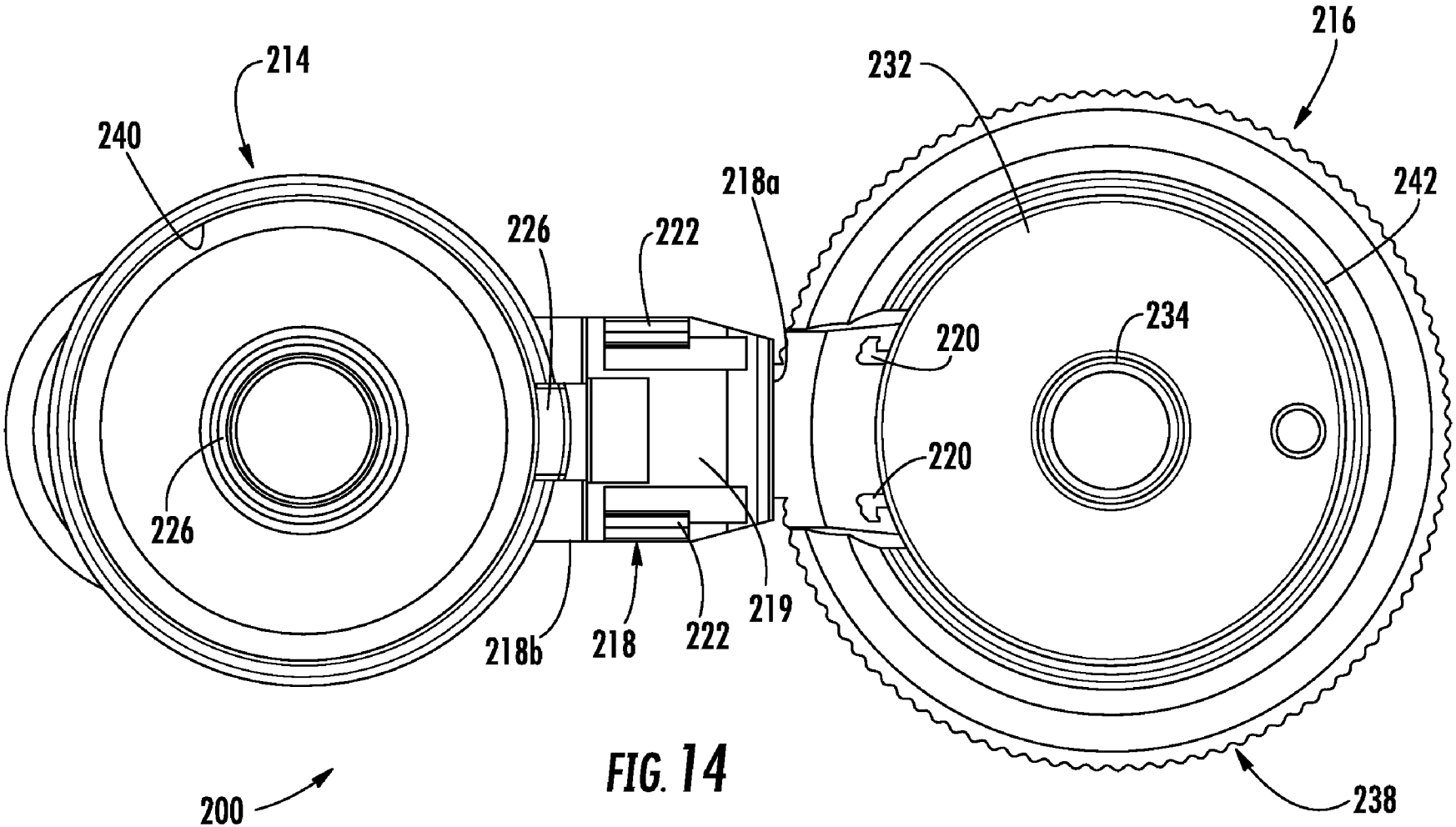
FIG. 14 is a top plan view thereof.

FIG. 11 shows the bottom side of the closure. As can be seen, the bottom of recess 154 does not interfere with the dispensing of contents through dispensing orifice 134 or the engagement of threads 146 onto a container.

FIGS. 12-19 illustrates a third and most preferred embodiment of the invention that combines all of the valued features of the earlier described embodiments, such as low profile hinge structure, symmetrical outer body structure, centrally positioned dispensing orifice, and complete peripheral seals. Similar to the embodiment in FIGS. 8-11, the dispensing orifice 234 is centrally aligned along the central axis of the closure body 216. However, the hinge structure 218 is modified so as to blend into the peripheral skirt 238 of the closure body 216, obviating the need to orient the closure 200 when mounted on a container 12.

The closure is generally indicated at 200 and comprises a sealing cap 214 and a closure body 216 integrally connected by a hinge structure 218 having two living hinges 218*a* and 218*b*.

The closure sealing cap 214 includes an upper wall 223, annular flange wall 224 depending downwardly from the upper wall 223, and a central sealing bead 226 depending downwardly from the center of the upper wall 223.

The closure body 216 has an upper wall 232 including a centrally positioned dispensing orifice 234, an annular sealing surface 236, an upper peripheral skirt 238*a* and a lower peripheral skirt 238*b*.

The sealing cap 214 is connected to the closure body 216 by a hinge structure 218 that is specifically designed to form a low profile when snapped into position. The living hinge 218 includes a hinge body 219 having a body hinge 218*a* adjacent to the closure body 216 and a sealing cap hinge 218*b* adjacent to the sealing cap 214. The hinge body 219 and the upper peripheral skirt 238*a* of the closure body 216 are provided with interfitting mating formations 220 and 222 that snap together when the hinge body 219 is rotated about the body hinge 218*a*. More specifically, the formations 220 and 222 comprise two hook-shaped tabs 220 in the surface of the upper peripheral flange 238*a* and two complimentary receiving tabs 222 on the hinge body 219. However, other similar configurations are possible. The intention of the hinge structure 218 is to provide a low profile, substantially flush engagement when snapped into position. In the as molded configuration, the closure body 216, hinge structure 218, and sealing cap 214 are laid out flat (See FIGS. 12, 14, 15, and 18). Upon removal from the mold, the hinge body 219 is pivoted about the body hinge 218*a* so that the sealing cap hinge 218*b* is positioned in proximity to the upper wall 232 of the closure body 216, with the sealing cap oriented 90 degrees relative to the upper wall of the closure body (see FIG. 13).

The sealing cap hinge 218*b* has a similar configuration to the hinge tab structure 26 shown in FIG. 4, and is movable between an open position (FIG. 13) and a closed position (not fully shown). When the sealing cap 214 is moved into the fully closed position the sealing bead 226 encircles and engages the outer walls of the dispensing orifice 234 to seal the dispensing orifice 234 at the opening.

Referring back to FIG. 12, the dispensing closure 200 is shown in its as-molded condition. Therefore hinges 218*a*, 218*b* are formed in a 90 degree open configuration and contrary to industry practice of forming living hinges in a 180 degree open or flat configuration.

To provide a complete peripheral seal around the upper wall 232, i.e. to prevent water from infiltrating onto the upper wall 232, the lower edge of the flange wall 224 of the sealing cap 214 includes a continuous peripheral sealing bead 240. When the sealing cap 214 is moved to the closed position, the sealing bead 240 engages the entire circumference of the annular sealing surface 236 to form a continuous primary seal around the circumference of the closure 200. In addition, to form a secondary sealing line, the outer peripheral edge of the upper wall 232 includes a peripheral sealing bead 242 that engages the inner wall of the sealing cap flange 224 when the sealing cap 214 is moved to the closed position.

Figure 19:
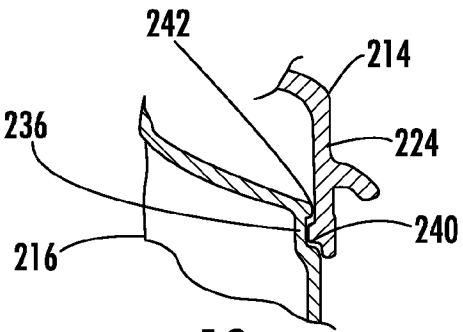
FIG. 19 is an enlarged cross-section view showing the sealing cap in the closure position and the two lines of peripheral sealing between the sealing cap flange and the annular sealing surface.

In particular, please refer to FIG. 19, which shows the sealing configuration in better detail.

Figure 15:
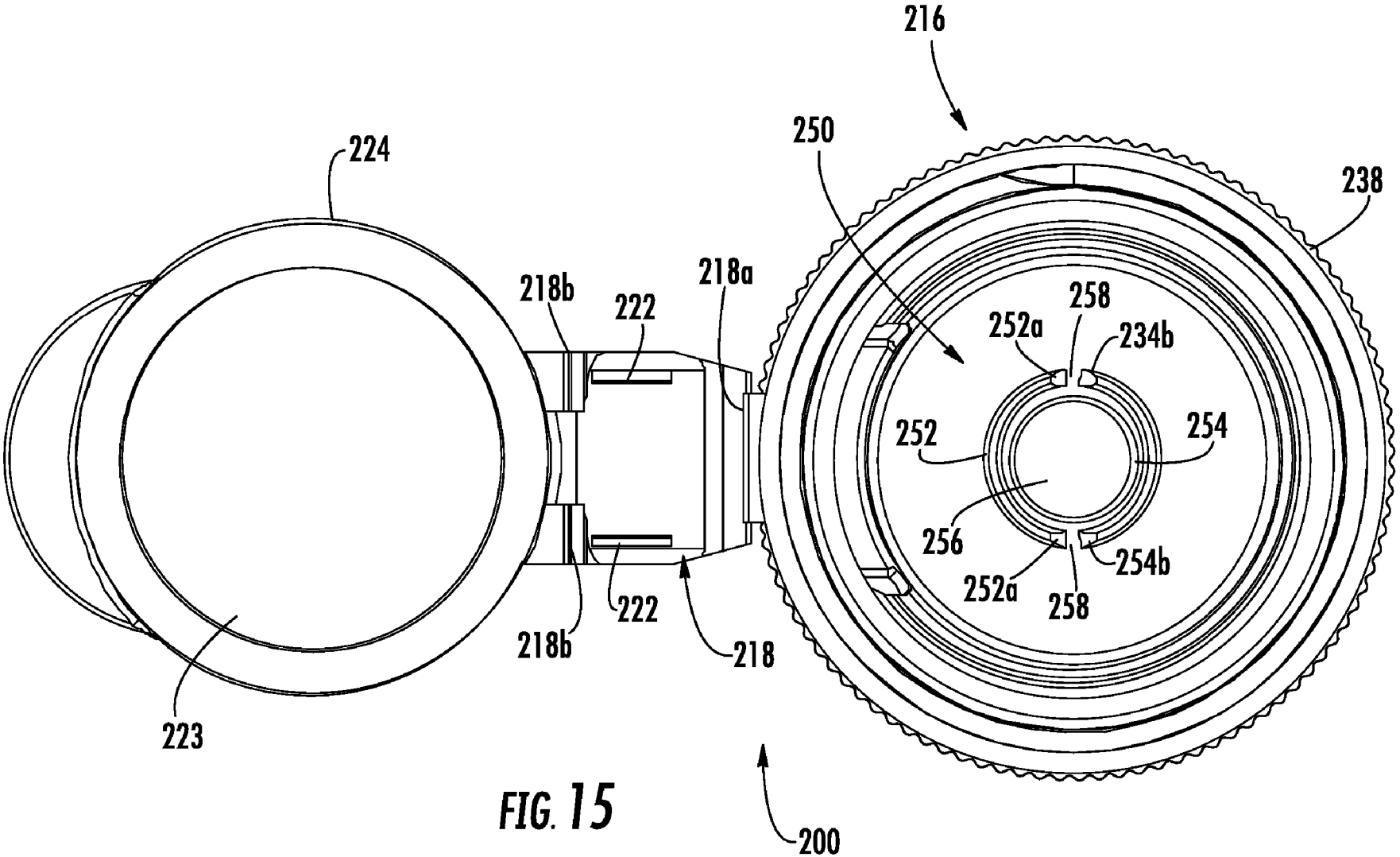
FIG. 15 is a bottom plan view thereof.
Figure 16:
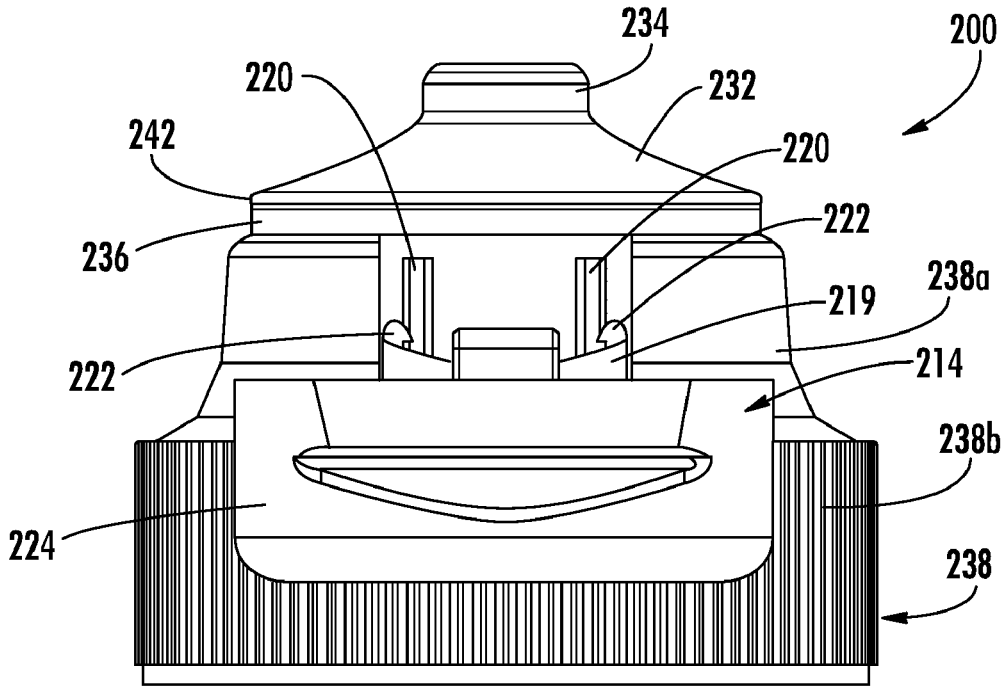
FIG. 16 is a left side plan view thereof.
Figure 17:
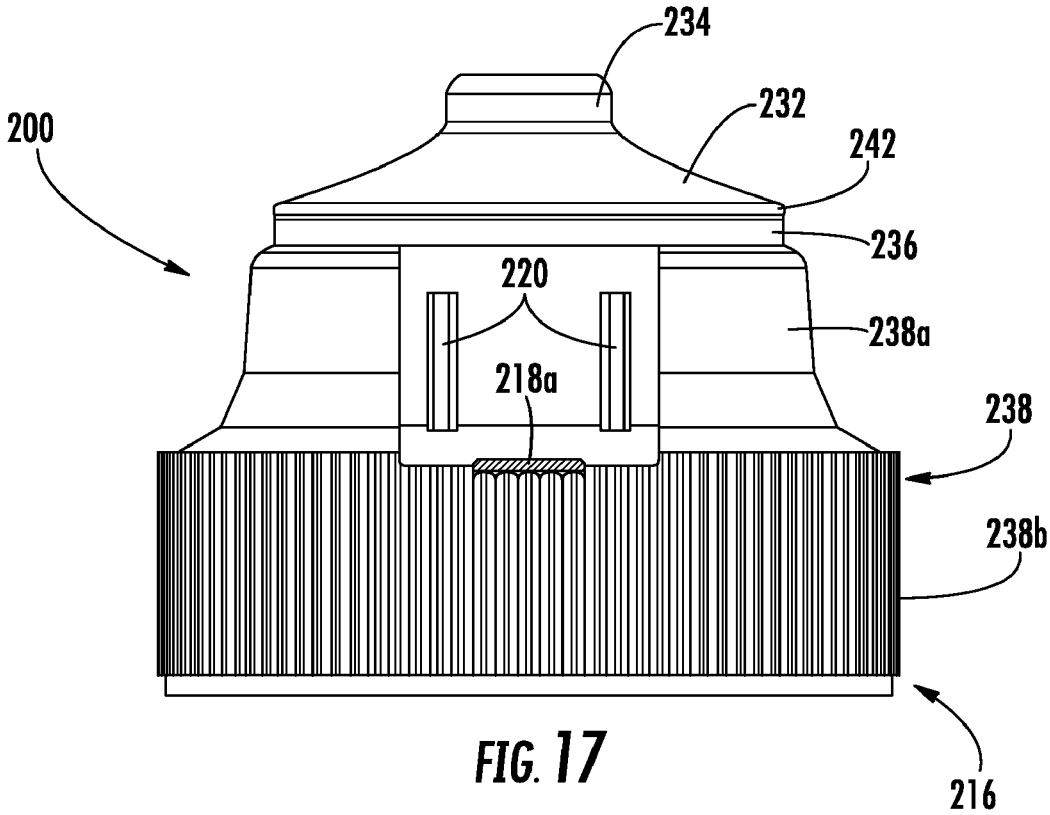
FIG. 17 is a cross-sectional view thereof.
Figure 18:
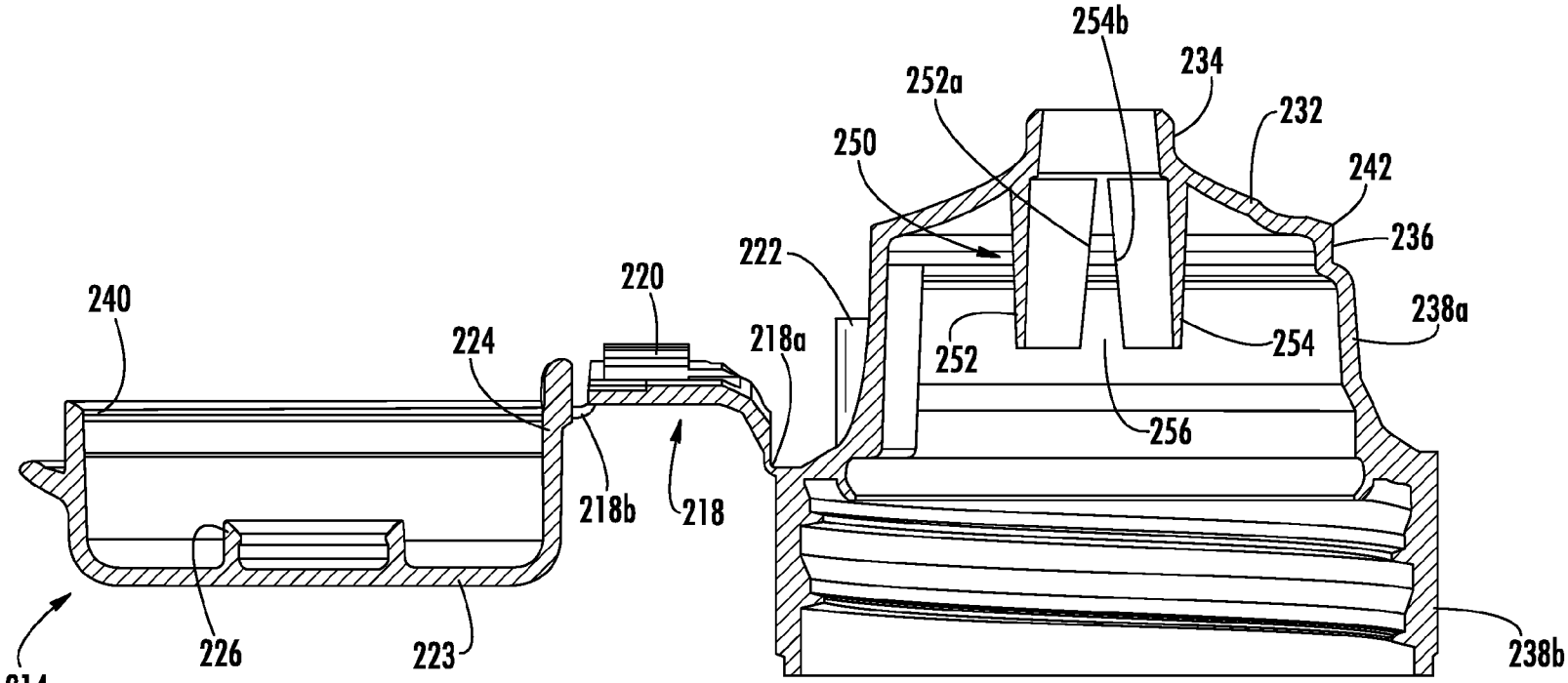
FIG. 18 is another cross-sectional view thereof.

Referring now to FIGS. 15 and 18, depending from the inside surface of the upper wall 232 and surrounding the dispensing orifice 234 is a flow modulator 250. The flow modulator 250 has two spaced-apart flow walls 252, 254 that are configured to face each other and form a channel 256. The flow walls 252, 254 have two restriction edges 252*a*, 254*b* that taper inwardly towards one another to form two relief openings 258 that are generally V-shaped. The function of the flow modulator 250 is to provide added restriction to the flow of a viscous fluid through the dispensing orifice and to prevent spillage of the fluid onto the outside surface of the upper wall 232.

Figure 20:
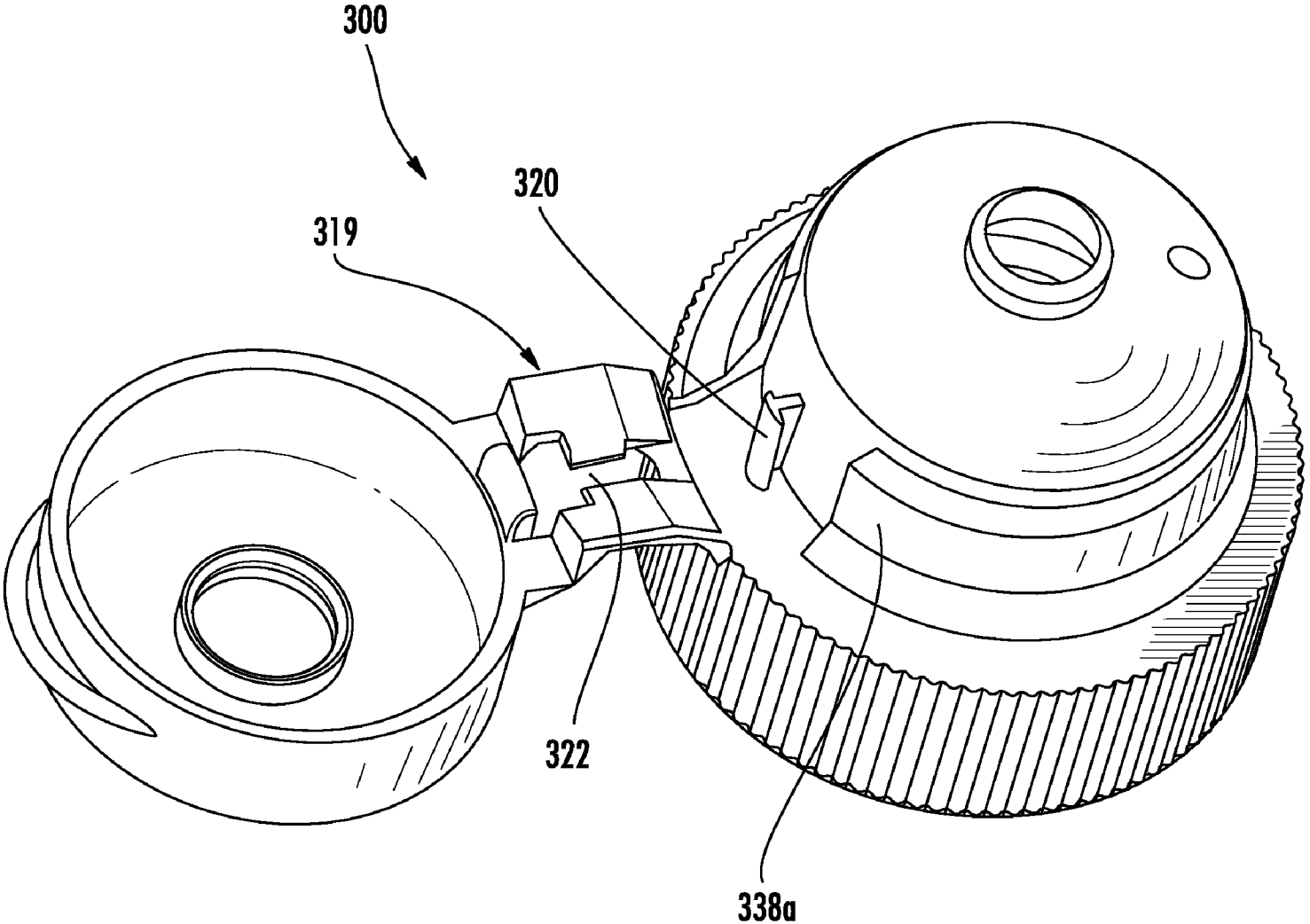
FIG. 20 is a perspective view of a fourth embodiment.
Figure 21:
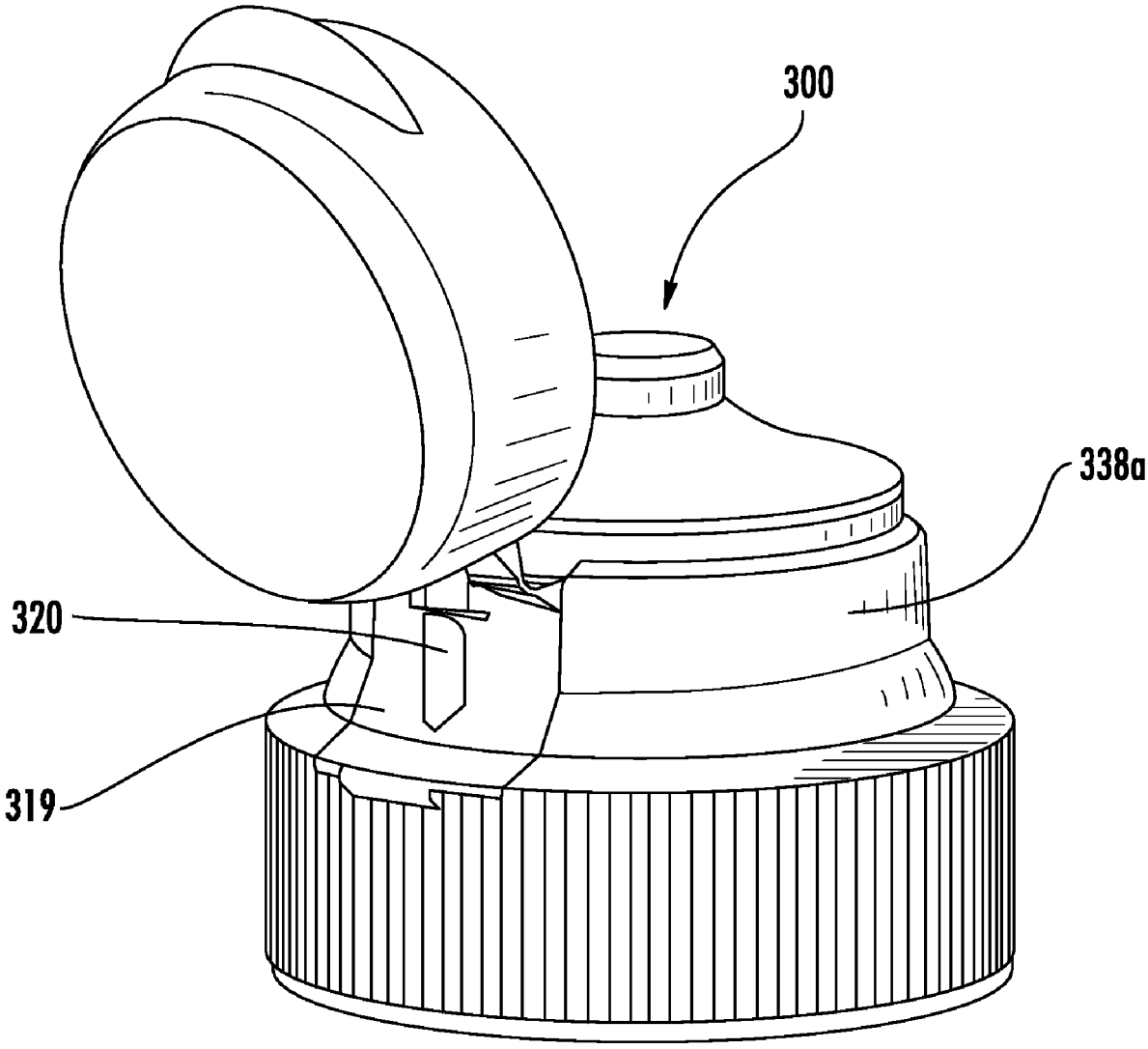
FIG. 21 is another perspective view of the fourth embodiment.

FIGS. 20 and 21 show an alternative embodiment for the configuration of the instant invention at 300. In particular, the interfitting mating formations comprise a T-shaped tab 320 located on the upper peripheral flange 338*a*, and a complimentary slot 322 located on the hinge body 319.

Figure 22:
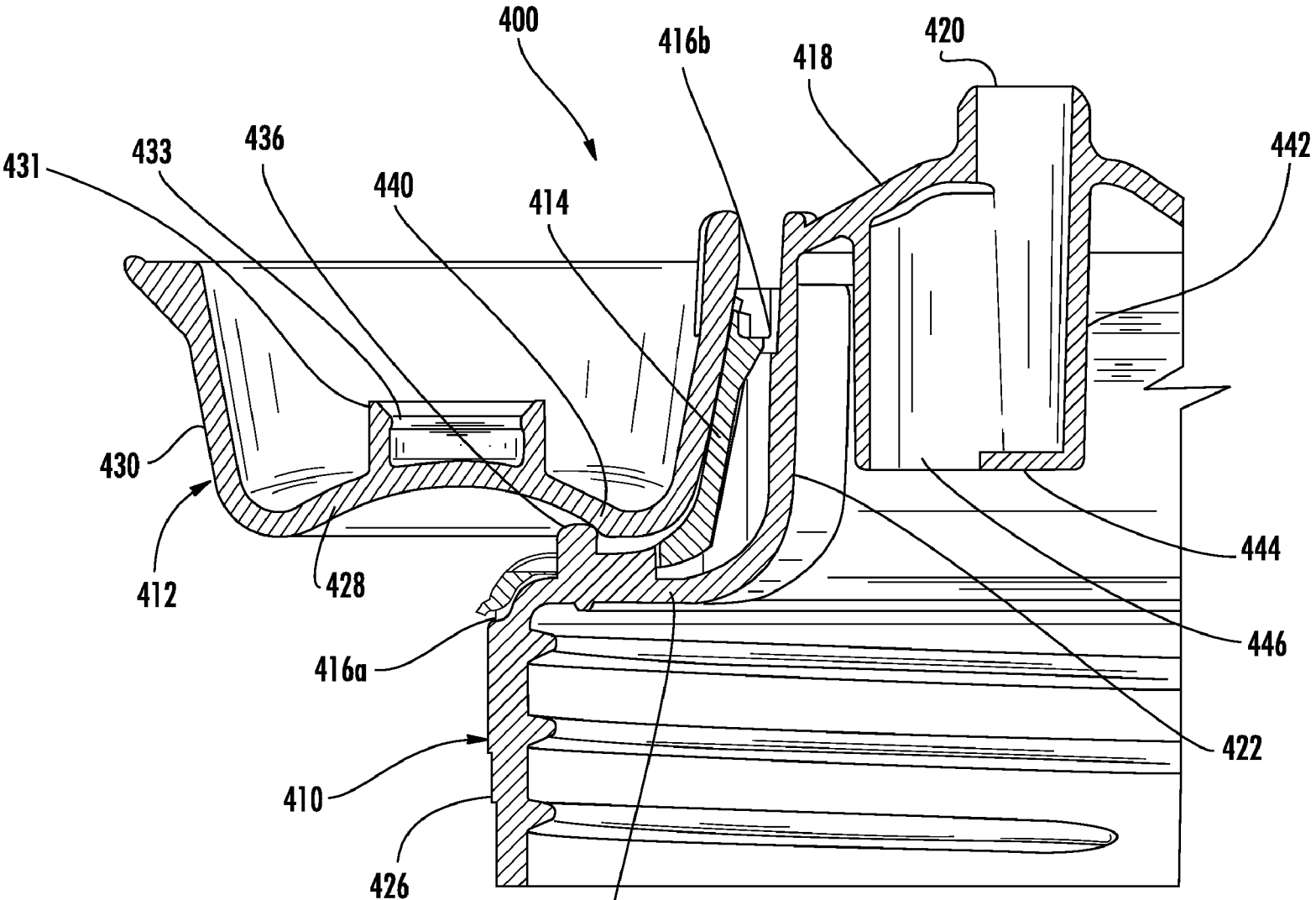
FIG. 22 is a cross-section view of a fifth embodiment of the invention illustrating a latch back feature.
Figure 23:
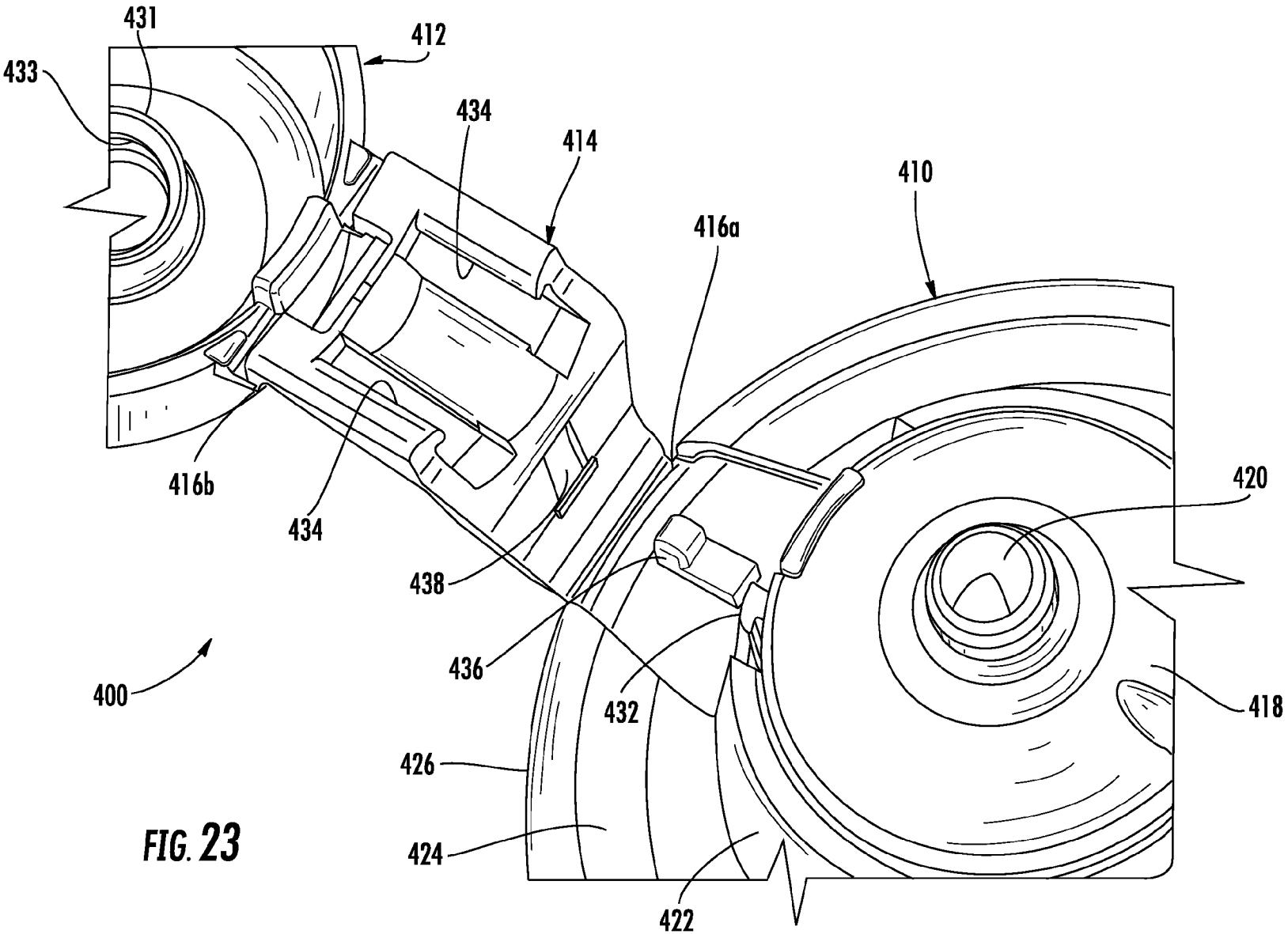
FIG. 23 is a bottom perspective view thereof showing the hinge body in an open position.
Figure 24:
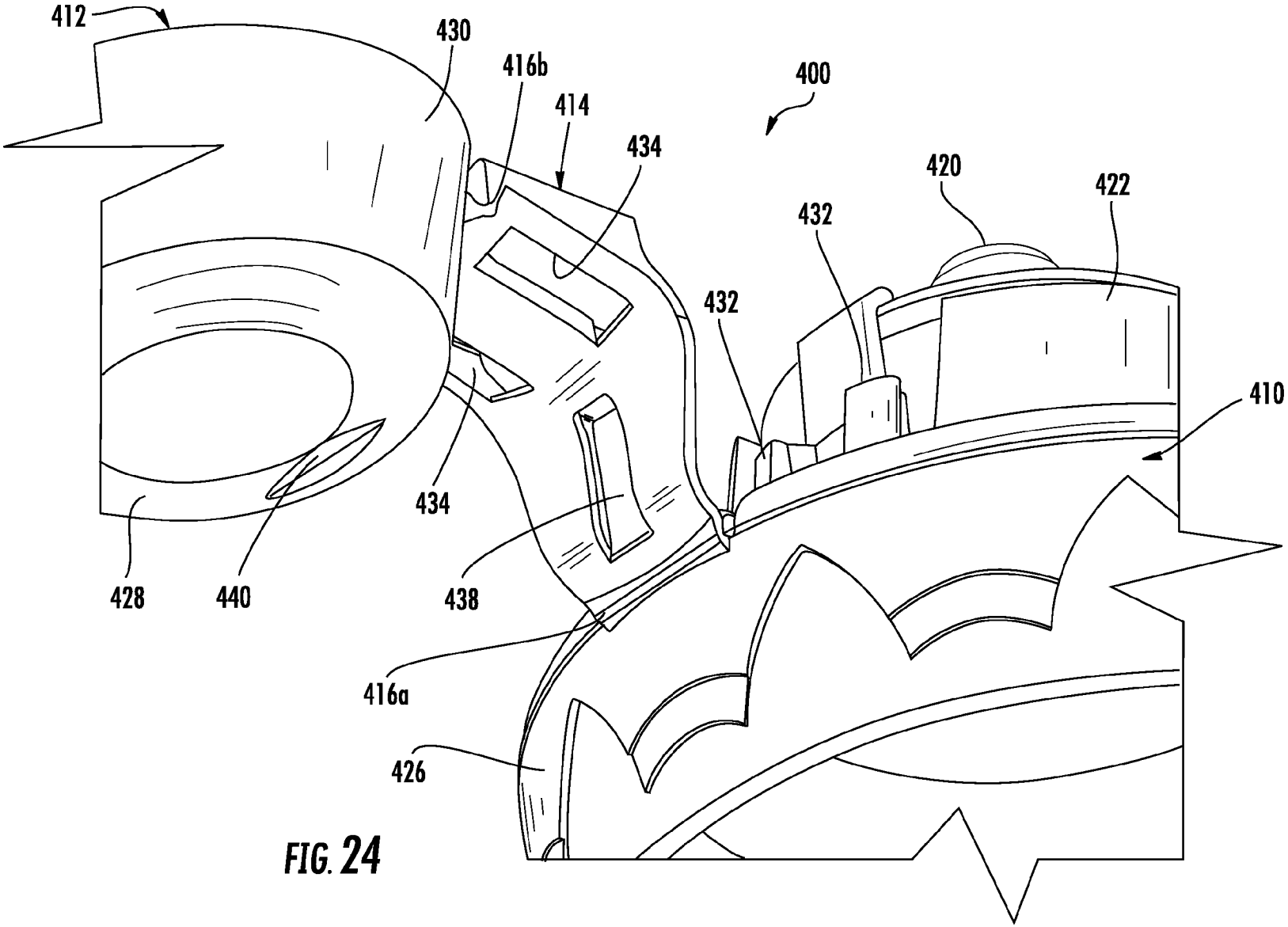
FIG. 24 is a top perspective view thereof showing the position of the latch bump and the clearance window.

Referring now to FIGS. 22-24, a fifth embodiment 400 of the dispensing closure is illustrated. Generally, the dispensing closure 400 comprises a closure body 410, a cap or lid 412, and a hinge body 414 having a first living hinge 416*a* connecting the hinge body 414 to the closure body 410, and a second living hinge 416*b* connecting the hinge body 414 to the cap 412. The overall construction of this embodiment is similar to the previous embodiment 300 with regard to the closure body 410, cap 412 and dual living hinges 416*a*, 416*b*. However, this fifth embodiment 400 further includes latch back structures, which will allow the cap 412 to be retained in an open position during dispensing. See FIG. 22 for fully open, latched position.

The closure body 410 includes an upper wall 418 having a dispensing orifice 420, an upper peripheral skirt 422 depending from the upper wall 418, a closure deck 424 depending from the upper peripheral skirt 422, and a lower peripheral skirt 426 depending from the closure deck 424. The lower peripheral skirt 426 has a diameter larger than the upper peripheral skirt 422 and is configured to be mounted on a container, either by a thread or a snap bead. The cap has an upper wall 428 and a wall flange 430 depending from the upper wall 428. On the upper wall 428 and within the periphery of the wall flange 430 is a sealing wall 431 depending downwardly from the center of the upper wall 428. The sealing wall 431 engages and seals the dispensing orifice 420 when the cap is rotated to the closed position. The sealing wall 431 further includes a sealing bead 433 to enhance the sealing action of the cap.

The hinge body 414 is hingeably movable about the first living hinge 416*a* from an open position to a closed position in facing mating relation with the upper peripheral skirt 422. To retain the hinge body 414 in position, the hinge body 414 and the upper peripheral skirt 422 including interfitting mating formations 432, 434 to secure the hinge body 414 in facing mating relation with the upper peripheral skirt 422. A second living hinge 416*b* joins the hinge body 414 to the sealing cap 412. The sealing cap 412 is hingeably movable from an open position to a closed position overlying the upper wall 418 of the closure body 410.

More specifically with regard to the latch back feature, the closure deck 424 is provided with a latch bump 436 adjacent to the hinge body 414 (See FIGS. 22 and 23). The latch bump 436 is formed on the surface of the closure deck 424 and protrudes upwardly through a clearance window 438 within the hinge body 414. A latch bead 440 is formed on the upper wall 428 of the cap 412 (See FIGS. 22 and 24). When the cap 412 is moved 180 degrees from the closed position to the open position, the lid latch bead 440 engages with the latch bump 436 and retains the cap or lid 412 in a fully open position.

Positioning the latch bump 436 on the closure deck 424 provides significant advantages in molding and allows for a substantial bump structure that can securely engage the latch bead 440. In particular, the latch bead 436 and window 438 permit the closure 400 to be molded without any undercuts in the mold.

Depending downwardly from the upper wall 418 of the closure body 410, is a flow restrictor 442 that encircles to the dispensing orifice 420. The flow restrictor 442 includes a bottom wall 442 and an opening 446 that is offset from the dispensing orifice 420. The combination of the offset opening 446 and bottom wall 444 prevents syneresis fluid from exiting the dispensing orifice 420 during the dispensing of the contents of the container.

Figure 25:
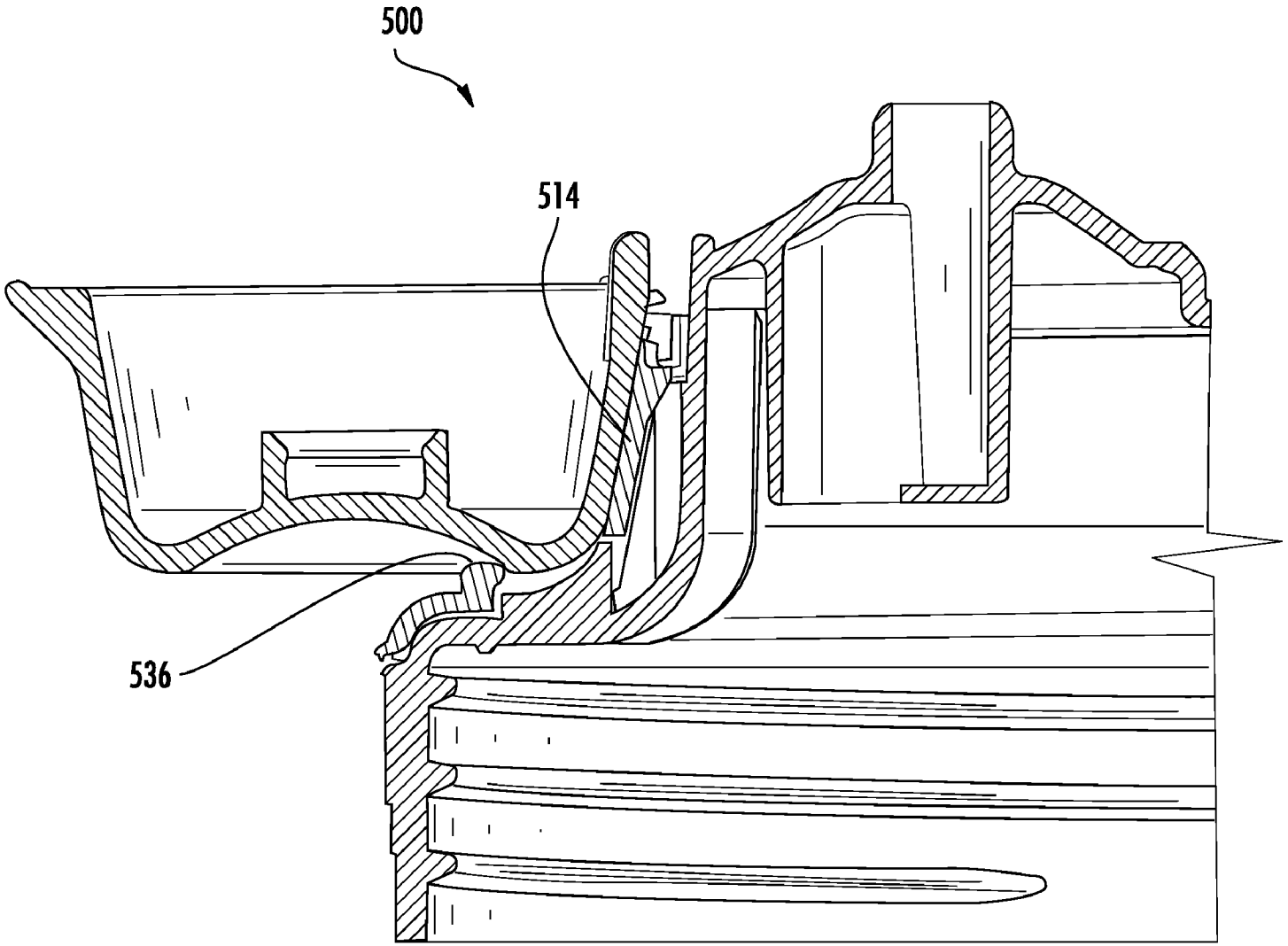
FIG. 25 is a cross-section view of a sixth embodiment of the invention illustrating a second latch back feature.
Figure 26:
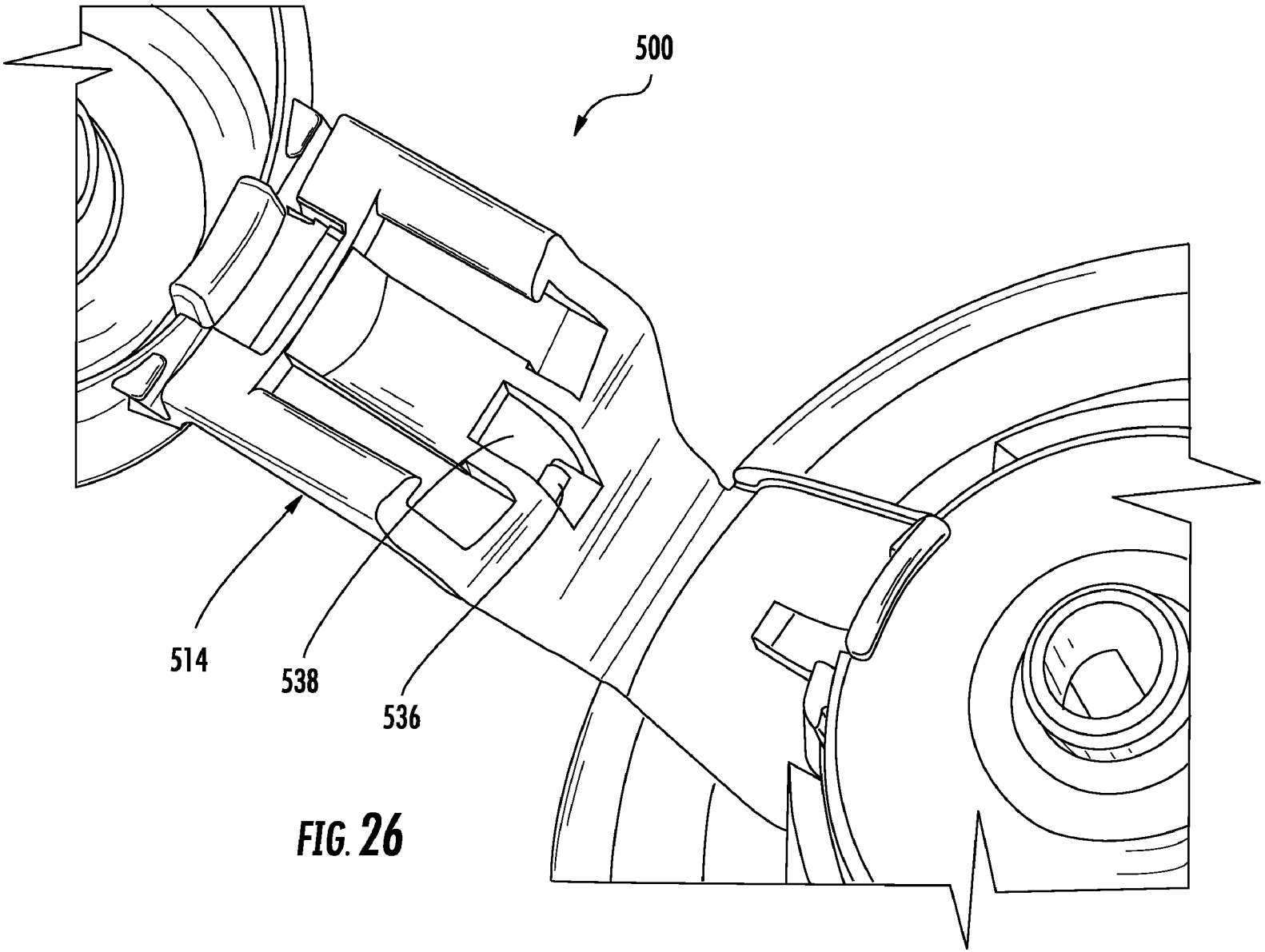
FIG. 26 is a bottom perspective view thereof showing the hinge body in an open position.
Figure 27:
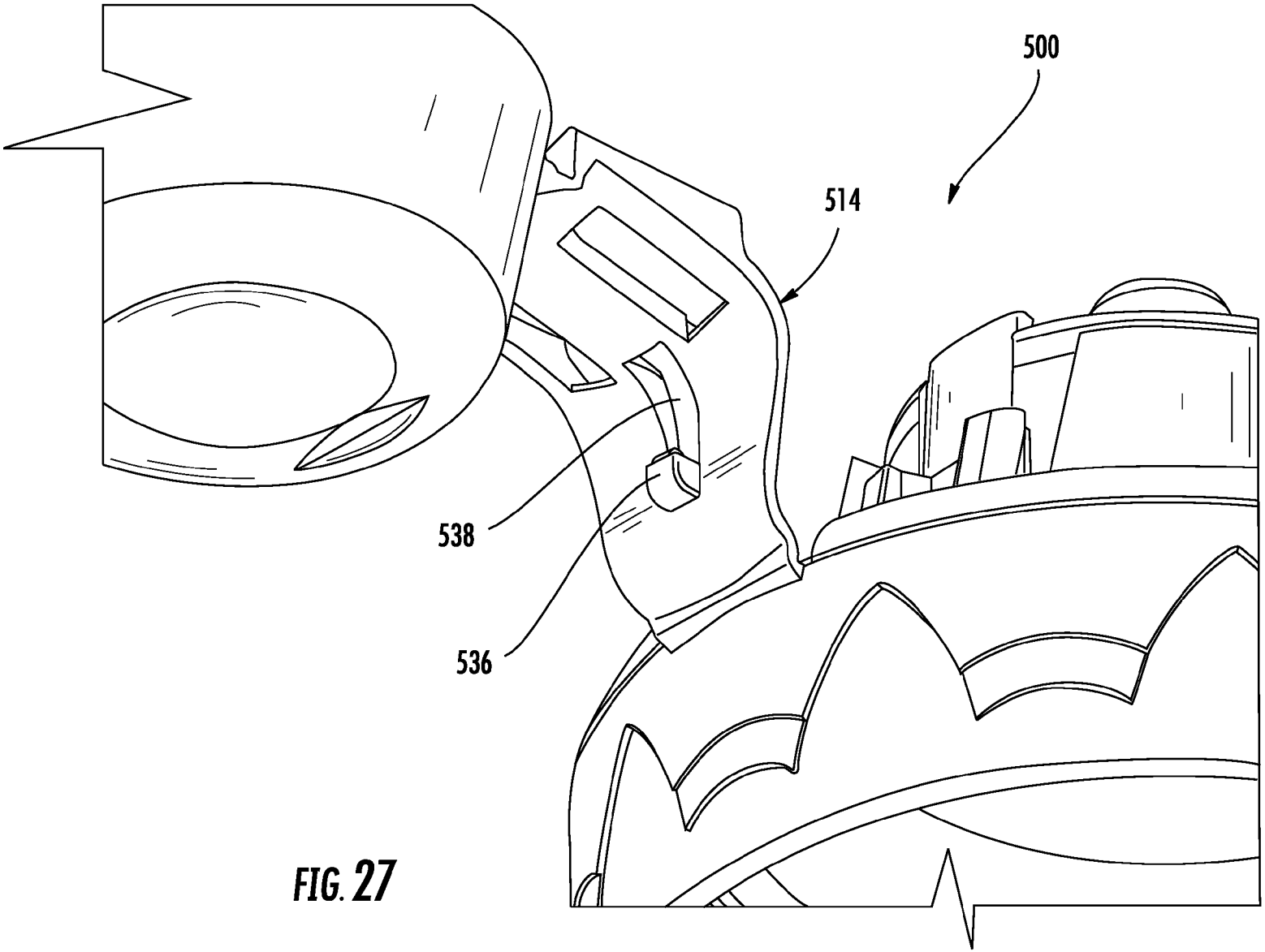
FIG. 27 is a top perspective view thereof showing the position of the latch bump and the clearance window.

Referring now to FIGS. 25-27, a sixth embodiment 500 of the dispensing closure is illustrated. This embodiment 500 is substantially similar to the fifth embodiment 400, except that the latch bump 536 is molded on the hinge body 514 rather than on the closure deck 524 (See FIGS. 25 and 27). This configuration requires a molding window 538 to be formed in the hinge body 514 in order to mold the latch bump 536 without an undercut in the mold.

Although the present invention has been described in considerable detail with reference to certain preferred embodiments thereof, other versions are possible to those with ordinary skill in the art. For example, other means could be used to attach the closure to the container other than screw threads, such as a snap-rim. Also, other arrangements of the interfitting mating formations could be used to anchor the hinge body 414 to the upper peripheral skirt 422. Therefore, the scope of the appended claims should not be limited to the description of the preferred embodiments contained herein.

What is claimed is:

1. A dispensing closure for a container, comprising:

a closure body including an upper wall having a dispensing orifice, said closure body further including an upper peripheral skirt depending from said upper wall, a closure deck depending from the upper peripheral skirt, and a lower peripheral skirt depending from said closure deck, said lower peripheral skirt having a diameter larger than said upper peripheral skirt, said lower peripheral skirt being configured to be mounted on a container;

a cap having an upper wall and a wall flange depending from said upper wall;

a hinge body;

a first living hinge joining a first end of said hinge body to said lower peripheral skirt, said hinge body being hingeably movable from an open position to a closed position in facing mating relation with said upper peripheral skirt, said hinge body and said upper peripheral skirt including interfitting mating formations to secure said hinge body in facing mating relation with said upper peripheral skirt;

a second living hinge joining a second end of said hinge body to said cap, said cap being hingeably movable from an open position to a closed position overlying said upper wall of said closure body;

a latch bump on said closure deck adjacent to said hinge; and a latch bead on the upper wall of said cap.

2. The article of claim 1, further comprising:

a thumb catch extending from the wall flange of the cap and on the opposite side of the cap from the hinge.

3. The article of claim 1, further comprising:

a lug extending from the wall flange of the cap and contacting the upper peripheral skirt for providing a snap-action to the movement of the cap from the open to the closed position.

4. The article of claim 1, further comprising:

screw threads on an inside portion of the lower peripheral skirt configured to mount onto a container.

5. The article of claim 1, further comprising:

sealing means for sealing the dispensing orifice.

6. The article of claim 5, wherein the sealing means is a sealing wall depending from the upper wall of the cap and configured to encircle and seal the dispensing orifice in a tight sealing engagement.

7. The article of claim 1, further comprising:

flow restriction means depending from the upper wall of the closure body and encircling the dispensing orifice.

8. The article of claim 7, wherein said flow restrictions means comprises:

a tubular wall depending downwardly from the upper of the closure body and encircling the dispensing orifice; and a bottom wall extending from the tubular wall forming an offset opening.

9. The article of claim 1, further comprising:

a surface forming a window through the said hinge body;

said latch bump protruding through said window when said hinge body is in the closed position.

10. A dispensing closure for a container, comprising:

a closure body including an upper wall having a dispensing orifice, said closure body further including an upper peripheral skirt depending from said upper wall, a closure deck depending from the upper peripheral skirt, and a lower peripheral skirt depending from said closure deck, said lower peripheral skirt having a diameter larger than said upper peripheral skirt, said lower peripheral skirt being configured to be mounted on a container;

a cap having an upper wall and a wall flange depending from said upper wall;

a hinge body;

a first living hinge joining a first end of said hinge body to said lower peripheral skirt, said hinge body being hingeably movable from an open position to a closed position in facing mating relation with said upper peripheral skirt, said hinge body and said upper peripheral skirt including interfitting mating formations to secure said hinge body in facing mating relation with said upper peripheral skirt;

a second living hinge joining a second end of said hinge body to said cap, said cap being hingeably movable from an open position to a closed position overlying said upper wall of said closure body;

a latch bump on said hinge and adjacent to said closure deck; and a latch bead on the upper wall of said cap.

11. The article of claim 10, further comprising:

a thumb catch extending from the wall flange of the cap and on the opposite side of the cap from the hinge.

12. The article of claim 10, further comprising:

a lug extending from the wall flange of the cap and contacting the upper peripheral skirt for providing a snap-action to the movement of the cap from the open to the closed position.

13. The article of claim 10, further comprising:

screw threads on an inside portion of the lower peripheral skirt configured to mount onto a container.

14. The article of claim 10, further comprising:

sealing means for sealing the dispensing orifice.

15. The article of claim 14, wherein the sealing means is a sealing wall depending from the upper wall of the cap and configured to encircle and seal the dispensing orifice in a tight sealing engagement.

16. The article of claim 10, further comprising:

flow restriction means depending from the upper wall of the closure body and encircling the dispensing orifice.

17. The article of claim 16, wherein said flow restrictions means comprises:

a tubular wall depending downwardly from the upper of the closure body and encircling the dispensing orifice; and a bottom wall extending from the tubular wall forming an offset opening.

* * * * *